United States Patent [19]

Mauranen et al.

[11] Patent Number: 4,608,124

[45] Date of Patent: Aug. 26, 1986

[54] METHOD FOR CUTTING A LEAD-IN STRIP FROM A PAPER WEB IN A PAPER MACHINE

[75] Inventors: Pekka Mauranen; Timo Vedenpää, both of Jyväskylä , Finland

[73] Assignee: Valmet Oy, Finland

[21] Appl. No.: 776,126

[22] Filed: Sep. 13, 1985

Related U.S. Application Data

[62] Division of Ser. No. 488,664, Apr. 26, 1983, Pat. No. 4,566,944.

[30] Foreign Application Priority Data

Apr. 27, 1982 [FI] Finland ..... 821446

[51] Int. Cl.[4] ..... D21F 1/36

[52] U.S. Cl. ..... 162/193; 162/194; 226/7

[58] Field of Search ..... 162/193, 255, 194, 286; 34/156; 226/7, 97

[56] References Cited

U.S. PATENT DOCUMENTS

| | | | |
|---|---|---|---|
| 1,338,094 | 4/1920 | Pope | 162/193 |
| 1,761,051 | 6/1930 | Rivard | 162/194 |
| 3,355,349 | 11/1967 | Devlin | 162/193 |
| 4,247,993 | 2/1981 | Lindstrom | 34/156 |
| 4,566,944 | 1/1986 | Mauranen et al. | 162/286 |

*Primary Examiner*—Steve Alvo

*Attorney, Agent, or Firm*—Steinberg & Raskin

[57] ABSTRACT

A method and apparatus for cutting a lead-in strip from a paper web in a multiple cylinder dryer section of a paper machine and for increasing the width of the lead-in strip by a so-called oblique draw. A cutting device for cutting the web is situated alongside a region of an unsupported draw of the web in the dryer section. According to the method, and apparatus a guide surface which extends in substantially parallel relationship to the plane of the web is associated with the web cutting device. A gas flow is directed over the guide surface to stabilize the run of the web during the cutting operation performed on the web by the cutting device. The gas flow is directed onto the guide surface from a nozzle opening situated adjacent to the leading edge region of the guide surface into a space between the guide surface and the web to produce an underpressure in the space which stabilizes the web run. Alternatively, two gas flows are directed from respective leading and trailing edge regions of the guide surface toward each other onto the guide surface into the space between the web and the guide surface to stabilize the web by means of an overpressure created in the space.

10 Claims, 5 Drawing Figures

METHOD FOR CUTTING A LEAD-IN STRIP FROM A PAPER WEB IN A PAPER MACHINE

This is a division of application Ser. No. 488,664, filed Apr. 26, 1983, now U.S. Pat. No. 4,566,944.

BACKGROUND OF THE INVENTION

The present invention relates generally to paper making machines and methods. In particular, the method of the present invention relates to the cutting of a lead-in strip of a paper web and for widening or increasing the width of the lead-in strip by the so-called oblique draw technique, the method employing a cutting device situated alongside a region of an unsupported draw of the web in the dryer section. The apparatus of the invention which performs the method is of the type which includes a substantially transversely extending beam situated alongside the region of the unsupported draw of the web in the dryer section on which a traversing carriage carrying a web cutting device is mounted.

Various so-called oblique draw arrangements are known in the prior art for cutting a lead-in strip from a paper web in the dryer section of a paper machine. Such arrangements are generally provided at the dry or downstream end of the dryer section. Such conventional arrangements utilize a spike-like cutting member which acts against a drying cylinder to cut the web, the cutting member being mounted on a mechanical traverse in order to accomplish an oblique draw or cut.

However, such prior art arrangements have the drawback that the spike-like cutting member often unavoidably scores the dryer cylinder and as a consequence becomes rapidly blunted or dulled thereby impairing the quality of the cutting operation.

It is also known in the prior art to use a cutting device comprising a circular saw-type device mounted on a traversing carriage to accomplish the oblique draw or cut. Still further, the oblique draw may be accomplished by a knife-like member, manually.

The use of conventional arrangements wherein the oblique draw or cut is made on a free or unsupported draw of the web has created problems since the tension of the web varies in the cross-machine direction so that fluttering or instability in the run of the web often occurs. Therefore, in those arrangements wherein the cutting device is situated alongside a free or unsupported draw of the paper web, a positive contact of the cutting device with the passing web cannot be reliably insured. In the case where the tension in the web varies and where the cutting device causes even a slight deflection in the web run, relatively large deviations in the run of the web are experienced with respect to the cutting device.

SUMMARY OF THE INVENTION

It is an object of the present invention to provide new and improved methods and apparatus for cutting a lead-in strip from a paper web in a dryer section of a paper machine whereby the above-identified drawbacks of conventional arrangements, among others, are eliminated.

Another object of the present invention is to provide a new and improved method and apparatus for cutting a lead-in strip from a paper web in a dryer section of a paper machine which are relatively uncomplicated yet reliable in both operation and construction.

Briefly, in accordance with the present invention, these and other objects are attained by providing a method wherein guide or carrying surface means are provided in association with web cutting means which are situated alongside a region of an unsupported draw of the web in the dryer section. The guide surface means are substantially parallel to the run of the web over at least the region of the unsupporting web draw which passes alongside the web cutting means. A gas flow is directed over the guide surface means to stabilize the run of the web over at least that region of the unsupported web draw which passes alongside the web cutting means to stabilize the web run as it passes alongside the web cutting means to be cut thereby.

In accordance with the apparatus of the present invention substantially planar guide surface means are associated with the web cutting device and means are provided for directing a gas flow onto the planar guide surface means into the space between the guide surface means and the web to stabilize the web run as it passes alongside the web cutting means. According to a preferred embodiment, the means for directing the gas flow onto the guide surface means are constituted by one or more nozzle openings for directing a gas flow in the direction of the web run or by mutually opposed nozzle openings for directing gas flows toward each other.

The invention provides for a stabilization of the unsupported draw of the web at least in the region which passes alongside the web cutting device. By directing a gas flow in a manner in accordance with the invention, a favorable contact-free support of the web is achieved. Moreover, the web is supported in a manner such that the web tension is substantially constant in at least that region so that thereby the web run alongside the web cutting device is quite stable. In this manner, a better quality and more reliable cutting operation of the web is achieved than has been possible heretofore.

Several preferred embodiments of the invention are disclosed. In one embodiment the carriage on which the cutting device is mounted is driven in its traversing movement by a compressed air motor, the compressed air being supplied to the motor being used in part to supply the gas flow directed onto the guide surface means. In another embodiment, an electric motor is employed for the same purpose in which case a blower can be coupled to the motor to provide the gas flow or, alternatively, the cooling air of the electric motor may be so employed. In this connection, it is understood that the requirements for the gas flow are not particularly great since the blowing or gas flow effect need not be extended over an extensive area of the web in the breadth or width direction. For example, the breadth of the zone in which the gas flow is directed onto the guide surface means may be only in the range of about 10 to 50 cm. The strength of the gas flow may be adjustable and preferably greater on each of the immediate sides of the web cutting device. In this connection, it is noted that the principles involved in the operation of underpressure and overpressure floating web dryers can be utilized in the lead-in strip cutting methods and apparatus of the present invention.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
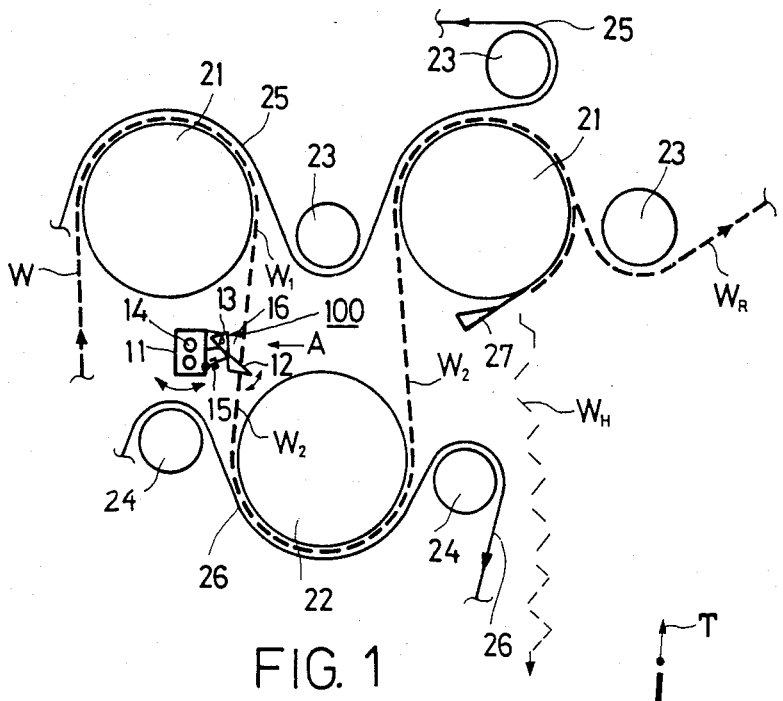
FIG. 1 is a schematic front elevation view of the downstream or dry end of a multiple cylinder dryer section of a paper machine which incorporates an oblique draw apparatus in accordance with the present invention for performing the method of the invention.

Referring now to the drawings wherein like reference characters designate identical or corresponding parts throughout the several views, and more particularly to FIG. 1, the upper cylinders of the downstream or dry end of a multiple cylinder dryer section of a paper machine are designated 21 and the lower cylinders of the dryer section designated 22. The web W is supported as it travels over the upper cylinders 21 by means of an upper felt 25 guided by guide rolls 23. The web W is supported in its travel over the lower cylinders 22 by a lower felt 26 which is guided by guide rolls 24. The web runs through the dryer section in a known manner over the heated surfaces of the cylinders 21 and 22. In particular, the web travels between cylinders of the upper and lower rows so that between the cylinder rows the web W has a free or unsupported draw.

An oblique draw arrangement 100 in accordance with the present invention is situated alongside a region of the unsupported draw or run $W_1$ between cylinders 21 and 22. In this connection, the apparatus 100 is generally disposed at the dry end of the multiple cylinder dryer section. The oblique draw apparatus 100 comprises a substantially transversely extending beam 11, i.e., a beam which extends parallel to the axes of the drying cylinders 21 and 22 from the drive side to the operating side of the paper machine. Component parts of the oblique draw apparatus are arranged to traverse the width or breadth of the paper machine in order to accomplish the oblique cut of the web to form the lead-in strip with an increasing width. To this end, a carriage 19 (FIG. 2) is mounted on the beam 11 so that rollers 20 associated with the carriage 19 engage rails 17 and 18 of the beam. A motor for driving the carriage 19 in its traversing movement is mounted on the carriage. The motor may comprise an electric motor, a compressed air motor or any other suitable drive means, such as a wire, chain or screw device as will be understood by those skilled in the art. However, the use of a motor mounted on the traversing carriage is preferred since the motor can produce, if required, a pressurized flow of air for use in stabilizing the web run in accordance with the present invention as described below.

Figure 2:
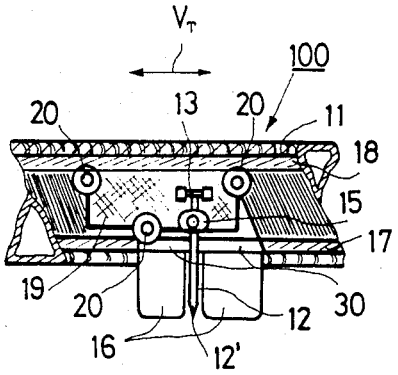
FIG. 2 is an enlarged view of the oblique draw arrangement illustrated in FIG. 1 viewed in the direction of arrow A of FIG. 1.

In the embodiment illustrated in FIGS. 1 and 2, the apparatus 100 includes a web cutting device in the form of a blade 12 having a sharp cutting edge 12′ mounted on the carriage 19. Thus, the blade 12 slices the paper web $W_1$ into two parts as the web passes alongside the apparatus 100. The two part web is designated $W_2$ in FIG. 1. As shown in FIG. 1, the web part $W_R$, which constitutes an edge strip of the web, is used for the lead-in of the web, while the other web part $W_H$ is detached from the cylinder 21 by means of a doctor 27 and conducted to suitable broke-receiving apparatus. As will be understood by those skilled in the art, as soon as the run of the lead-in strip $W_R$ has become stabilized, the oblique draw apparatus 100 of the invention is displaced on the traversing beam 11 whereupon the lead-in strip $W_R$ is widened or increased in width and such that the web part $W_H$ correspondingly decreases in width. When the web W has been extended to its full width, the oblique draw apparatus 100 is positioned over the margin of the web W and its blade 12 is either located outside the width of the web and/or is swivelled away from the web W as indicated by the double-headed arrow in FIG. 1.

Thus, as shown in FIG. 1, the blade 12 is mounted to the carriage 19 by means of a pivot pn 13 so as to be pivotable by a suitable actuation device 15 into and out of its operating position. Alternatively, the beam 11 may itself be arranged to be pivotable about an axis 14 for the same purpose.

In accordance with the present invention, the run of the web being cut by the blade 12 is stabilized through the provision of a guide or carrying surface or surfaces 16 situated on either side of the blade 12 in the cross-machine direction. Further, in accordance with the invention, a flow of air is directed onto the guide surface 16 in order to achieve the stabilizing effect and contact-free supporting action sought by the present invention. In this connection, as noted above, the method and apparatus of the invention provides a more reliable and better quality cutting of the web W than has been possible heretofore. In this connection it is well known that a web W will exhibit fluttering as well as an unstable run in a multiple cylinder dryer section during its free run between cylinders mainly due to the air currents induced by various rotating members and by the variations in the web tension in the cross-machine direction.

Figure 3:
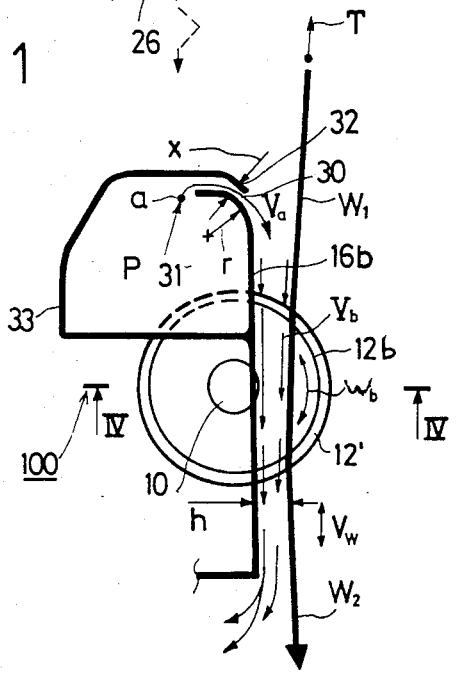
FIG. 3 is a schematic side elevation view of another embodiment of an oblique draw arrangement utilizing a rotary cutter disc, in accordance with the present invention.
Figure 4:
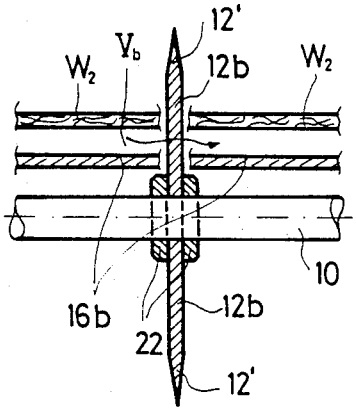
FIG. 4 is a section view taken along line IV—IV of FIG. 3.

In the embodiments illustrated in FIGS. 1–4, the region of the unsupported draw of the web situated alongside the cutting blade is stabilized by means of an underpressure created between the guide surface and the web. The embodiment of FIGS. 3 and 4 differs from that of FIGS. 1 and 2 only in that whereas the web cutting means of the embodiment of FIGS. 1 and 2 are constituted by a blade 12 which is pivotally mounted about the axis 13 so as to be pivotable by the actuation means 15 into its operative and non-operative positions, the web cutting means of the embodiment of FIGS. 3 and 4 are constituted by a cutting disc 12*b* rotatably mounted on a shaft 10 and which is rotated, for example, by an electric motor, a compressed-air motor or other suitable means arranged in conjunction with the carriage 19. The cutting disc 12*b* is provided with a cutting edge 12′ although it is understood that it is also possible to provide a serrated blade on the disc resembling a circular saw. The guide surface forming a part of the oblique draw apparatus 100 in FIG. 3 is designated 16*b*.

In the embodiments of FIGS. 1–4, as noted above, the region of the unsupported draw of the web which passes alongside the oblique draw apparatus 100 is stabilized by means of an underpressure. Thus, the run of the web $W_1$ is stabilized so as to be contiguous to the guide surface 16, 16*b*, the web being spaced a substantially constant distance h therefrom. This stabilizing effect is achieved by directing an air flow from a box 33 forming a component part of the apparatus 100 through a nozzle slit 30 thereof into contiguity with the guide surface 16, 16*b* substantially parallel thereto. The nozzle slit 30, which extends in the cross-machine direction of the web W over substantially the entire width of the guide surface 16, 16*b* is defined by a rounded portion 31 of the leading edge region of the plate constituting the guide surface 16, 16*b* and by a marginal portion of the wall 32 of the box 33. The radius of curvature of the rounded portion 31 and its arc length are such that the air flow a which discharges from the nozzle slit 30 with a velocity $V_a$ follows along the surface of the rounded portion 31 onto the planar surface 16, 16*b* due to the so-called Coanda effect. The radius of curvature of the rounded portion 31 is designated r while the width of the nozzle slit 30 is designated x. In this connection reference is made regarding the principles of such air flow as applied to web dryers to U.S. Pat. No. 4,237,993. When the velocity $V_a$ of the air flow is suitably chosen, a sufficient dynamic underpressure is created in the region of the guide surface 16, 16*b* to stabilize the run of the web $W_1$ in conjunction with the blade 12, 12*b* and during the cutting of the web $W_1$.

Figure 5:
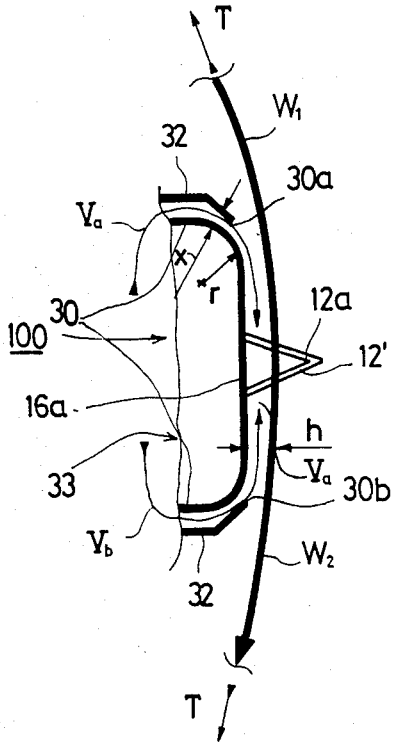
FIG. 5 is a schematic side elevation view of a further embodiment of an oblique draw arrangement in accordance with the present invention wherein an overpressure is used to stabilize the web run.

Referring now to the embodiment illustrated in FIG. 5, the web cutting means is constituted by a stationary blade 12*a* having a cutting edge 12'. The blade 12*a* is disposed substantially at the center of the guide surface 16*a*. A pair of nozzle slits 30*a* and 30*b* are provided which open up onto the respective leading and trailing edge regions of the guide surface 16*a* to direct mutually opposed air flows $V_a$ and $V_b$ into the space between the web $W_1$, $W_2$ and the guide surface 16*a*. In this manner, an overpressure is created in this space which stabilizes the run of the web $W_1$, $W_2$ in conjunction with the guide surface 16*a*.

In FIG. 2, the speed at which the carriage 19 traverses the web is designated $V_T$. The web tension is designated in FIGS. 3 and 5 by T and the distance of the web W from the guide surface 16, 16*a* and 16*b* is designated h.

As noted above, a motor may be mounted on the carriage 19 for driving the same in its traversing movement and in this connection an electric motor, a compressed air motor or any other equivalent motor may be used. Moreover, the motor can also constitute means for driving the rotatable cutting disc 12*b*. The air flow directed onto the guide surface 16, 16*a*, 16*b* through the nozzle slit 30, 30*a*, 30*b* may advantageously be produced by means of a blower associated with the motor. In the case where an electric motor is used, the air flow may advantageously be derived from cooling air supplied to the electric motor. In the case where a compressed air motor is employed, the air flow directed onto the carrying surface 16, 16*a*, 16*b* may be obtained from the exhaust air of the compressed air motor or from the supply duct communicating with the compressed air motor. Of course, the air flow can also be derived from an external air source and the carriage 19 can be driven in its traversing movement by means of an external motor. Additionally, it is possible, if required, to use an ejector to obtain the required quantities of air. The pressure P (FIG. 3) of the air which is directed through the nozzle slits 30, 30*a* and 30*b* is relatively low and usually is less than about 5,000 Pa.

It is also possible to use web cutting means other than those described in the preferred embodiments. For example, sharp jets of water may be used to cut the web as is known per se in the art.

Of course, the apparatus described above also comprises control means for controlling the various functions of the component parts of the apparatus. Since these control means are known in themselves, they have not been shown or described for the sake of clarity.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for forming a lead-in strip from a paper web in a multiple cylinder dryer section of a paper machine and for increasing the width of the lead-in strip by an oblique draw, and wherein a cutter for cutting the web are situated alongside a region of an unsupported draw of the web in the dryer section, the method comprising the steps of:

providing a guide surface in association with the web cutter, the guide surface being substantially parallel to the run of the web over at least the region of the unsupported web draw which passes alongside the web cutter;

directing a gas flow substantially parallel to the guide surface into a space between said guide and said web to stabilize the run of the web over at least the region of the unsupported web draw which passes alongside the web cutter to stabilize the web run as it passes alongside the web cutter; and cutting the stabilized web as it passes the web cutter.

2. The method of claim 1 wherein said gas flow directing step includes directing a gas flow at a certain velocity and in the direction of the run of the web which passes alongside the web cutter into the space between the web and the guide surface to produce an underpressure stabilizing the running of the web.

3. The method of claim 2 wherein said gas flow is directed through at least one nozzle slit located adjacent to the guide surface.

4. The method of claim 3 wherein the guide surface includes a leading edge region and wherein at least one nozzle slit is located adjacent to the leading edge region of the guide surface means.

5. The method of claim 3 wherein the gas flow directed through the at least one nozzle slit is constituted by an air jet.

6. The method of claim 1 wherein the guide surface includes a leading edge region and a trailing edge region and wherein said gas flow directing step includes directing a first gas flow onto the guide surface into a space between the web and the guide surface from the leading edge region thereof and directing a second gas flow onto the guide surface into the space between the web and the guide surface from the trailing edge region thereof towards the first gas flow, the first and second gas flows producing an overpressure stabilizing the run of the web.

7. The method of claim 6 wherein the first and second gas flows are directed through respective nozzle slits located adjacent to the leading and trailing edge regions of the guide surface.

8. The method of claim 7 wherein the gas flow is directed through the nozzle slits are constituted by air jets.

9. The method of claim 1 wherein the web cutter includes a stationary blade.

10. The method of claim 1 wherein the web cutter include a rotatable cutting disc and motor means for rotating the cutting disc.

* * * * *